United States Patent [19]

Wakefield

[11] Patent Number: 5,056,718

[45] Date of Patent: Oct. 15, 1991

[54] JETTING NOZZLE

[76] Inventor: Anthony W. Wakefield, Little Casterton Road, Stamford, Lincs. PE9 1BE, United Kingdom

[21] Appl. No.: 270,043

[22] Filed: Nov. 14, 1988

[30] Foreign Application Priority Data

Nov. 13, 1987 [GB] United Kingdom ..... 8726688

[51] Int. Cl.[5] ..... B05B 1/32

[52] U.S. Cl. ..... 239/441; 239/DIG. 7; 239/457

[58] Field of Search ..... 239/DIG. 21, 441, 456, 239/299, 457, 440, 443, DIG. 7

[56] References Cited

U.S. PATENT DOCUMENTS

| | | | |
|---|---|---|---|
| 573,721 | 12/1896 | Stewart | 239/441 |
| 1,734,580 | 11/1929 | Hippenmeyer | 239/441 X |
| 3,117,726 | 1/1964 | Schoberg | 239/457 X |
| 3,892,361 | 7/1975 | Mocarski . | |
| 3,984,054 | 10/1972 | Frochaux | 239/DIG. 21 X |
| 4,095,747 | 6/1978 | Anderson | 239/441 X |
| 4,154,405 | 5/1979 | Stenstrom . | |
| 4,342,425 | 8/1982 | Vickers . | |
| 4,826,084 | 5/1989 | Wallace | 239/290 |

FOREIGN PATENT DOCUMENTS

| | | | |
|---|---|---|---|
| 0057790 | 8/1982 | European Pat. Off. . | |
| 0091758 | 10/1983 | European Pat. Off. . | |
| 3007290 | 9/1981 | Fed. Rep. of Germany | 239/441 |
| 915485 | 1/1963 | United Kingdom . | |
| 1362077 | 7/1974 | United Kingdom . | |

*Primary Examiner*—Andres Kashnikow
*Assistant Examiner*—Kevin Weldon

[57] ABSTRACT

A jetting nozzle for producing a high velocity fluid has its external surface formed as a fluidic surface and directs a second lower velocity jet of fluid, which may be the same as or different from the fluid of the high velocity jet, onto the external surface such that the fluid of the second jet flows in contact with the fluidic surface to surround the high velocity jet, thereby reducing the rate of divergence of the high velocity jet preserving its energy and increasing its effective range.

13 Claims, 3 Drawing Sheets

JETTING NOZZLE

BACKGROUND OF THE INVENTION

1. Field of the Invention

This invention relates to a jetting nozzle for production of a high velocity fluid jet.

2. Description of Related Art

The energy in a fluid jet is dependent upon a velocity difference across the jetting nozzle and the flow through the jetting nozzle. Thus, for a given energy jet, a high pressure difference across the jetting nozzle requires a small exit diameter from the nozzle. Once the jet has emerged it spreads out as it entrains the surrounding fluid and since momentum is approximately conserved the jet slows down. The effective range of any fluid jet can be expressed in terms of a number of jet diameters. Thus, for a high energy, high velocity jet, because the jet diameter is small the effective range is also small.

When the fluid of the jet is similar to the surrounding fluid the jet enlarges at an angle of divergence which is characteristic for the fluid. However, when the fluids are dissimilar and the velocity high, the jet enlarges more rapidly and starts to disintegrate at a much shorter distance from the nozzle exit. At very high velocities the jet may disintegrate immediately on, leaving the nozzle exit.

High velocity liquid jets are used, for example, in air or liquid environments for cutting soil in, for example dredging and excavation operations using typical pressures of from 0.3 to 3 MPa and jet diameters of from 8–40 mm. High velocity jets are also used in an air environment for cutting and moving materials for example in monitor mining of minerals such as tin or china clay and for clearing and cooling the stopes in gold mines and the like. For such operations the generating pressures are typically from 3–15 MPa and the jet diameter is from 5–10 mm. In either case the jet does not carry sufficiently far before it disintegrates and the jet must be held much closer to the surface on which it is operating than is practicable.

High velocity jets at typical generating pressures from 10–100 MPa with jet diameters of from 0.5–5 mm are also used for cutting materials such as steel or concrete and for cleaning operations. These jets frequently contain an abrasive. For such operations the effective range of jet is critical.

For all these operations it is highly desirable to provide a jetting nozzle which allows production of a high velocity fluid jet having a greater effective range than conventional jetting nozzles.

SUMMARY OF THE INVENTION

According to one aspect of the invention, a jetting nozzle for producing a high velocity fluid jet has its external surface formed as a fluidic surface and means are provided for forming a second lower velocity jet of fluid, which may be the same as or different from the fluid of the high velocity jet such that the fluid of the second jet flows in contact with the fluidic surface to surround the high velocity jet, thereby reducing the rate of divergence of the high velocity jet preserving its energy and increasing its effective range.

The jetting nozzle of the invention in addition to having the advantage of producing a jet of greater effective range also provides other advantages. First, the fluid of the second, low velocity jet will assist in washing away cut material thereby clearing the passage for the high velocity jet and secondly serves to reduce noise levels caused by cavitation. Cavitation occurs both within the core of the high velocity jet and in the entrainment zone when a high velocity jet is used in a liquid medium, for example underwater. The noise levels produced by this cavitation severely limit the use of high velocity jets underwater. The production of the secondary jet by the jetting nozzle of the invention substantially reduces cavitation in the entrainment zone and, although it does not affect cavitation in the core of the high velocity jet, the effect of the low velocity jet surrounding the high velocity jet is to form an accoustic barrier which considerably reduces the noise levels.

In the jetting nozzle of the, invention the interior construction of the nozzle may be of any desired form but the outer surface must be a fluidic surface, that is to say a surface of such shape that a fluid passing over the surface is constrained to flow in contact with the surface. According to the present invention, the fluidic surface is directed towards the nozzle exit so that the secondary fluid is diverted from what would be its normal flow direction to converge on the nozzle exit to surround the high velocity jet.

The secondary fluid may be derived from the main flow of fluid providing the high velocity jet, for example by bleeding off a side stream of fluid, or may be provided from another source. The outer jet will normally be fed onto the fluidic surface with a radial component for ease of manufacture of the jetting nozzle but this is not essential and in some instances the outer jet may be fed axially onto the fluidic surface.

According to a second aspect of the invention, the invention provides apparatus for producing a high volume, low velocity jet from a low volume, high pressure supply, which comprises means for supplying fluid at low volume and high pressure and within or adjacent the outlet of said supply means, a converter device arranged axially of the direction of flow of the fluid and comprising a body having a fluidic surface whereby fluid issues from the outlet as an annular jet at low volume and high velocity and is constrained by the contours of the surface of the converter device to flow in contact with the surface so that the jet area is increased thereby increasing the flow and reducing the velocity of the jet.

When the fluid is highly viscous and/or contains particulate material the converter may need to be spaced downstream from the outlet of the supply means to allow unimpended flow of the fluid over the fluidic surface.

The arrangement according to this second aspect of the invention is virtually identical to the arrangement according to the first aspect except that there is no provision for supply of a high velocity jet through the converter device.

Forms of jetting nozzles in accordance with the invention will now be described in greater detail by way of example with reference to the drawings in which:

DETAILED DESCRIPTION OF PREFERRED EMBODIMENTS

Figure 1:
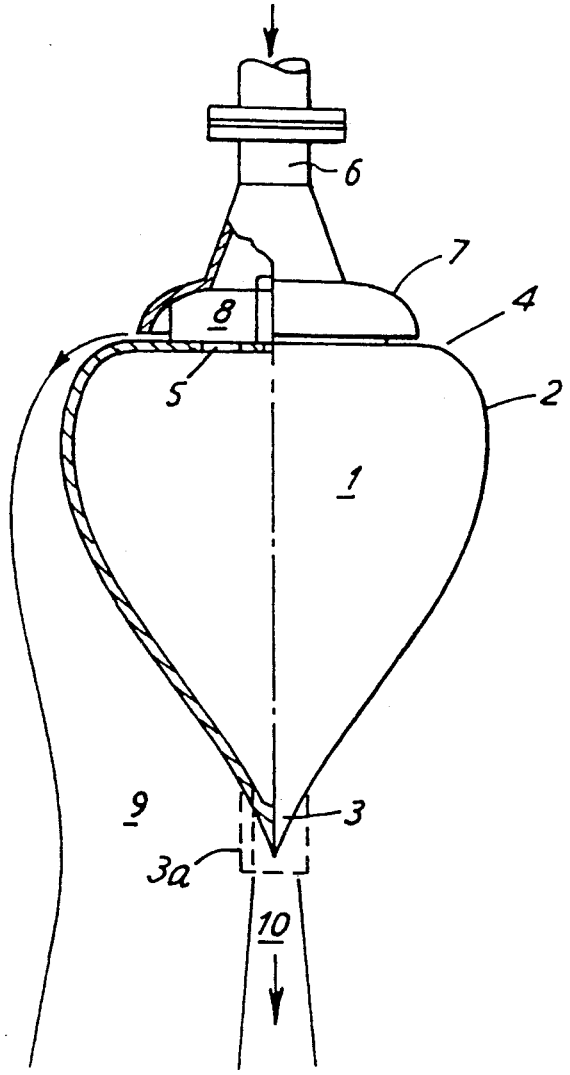
FIGS. 1 to 4 are schematic representations of four embodiments of jetting nozzle according to the first aspect of the invention.

According to FIG. 1 a first form of jetting nozzle has a first plenum chamber 1, with a substantially heart shaped outer surface 2 providing a fluidic surface. At the narrow end of the heart shaped surface 2 the first plenum chamber 1 opens into a nozzle exit 3. At the wider end 4 of the heart shaped surface 2 are inlets 5 for introduction of high pressure fluid from pipe 6. The pipe 6 terminates in a bell 7 adjacent the wide end 4 of surface 2, the bell 7 enclosing the apertures 5 and defining a second plenum 8. The end of bell 7 is spaced from end 4 to allow a sidestream of fluid to pass radially outwardly. This sidestream of fluid forms a low velocity outer jet 9 which is constrained by the shape of surface 2 to flow in close contact thereto so as to surround a high velocity jet 10 issuing from nozzle exit 3. The nozzle exit 3 may be provided with a valved outlet 3*a* to adjust or close off the high velocity jet 10. Moreover, the bell 7 may be mounted so that it can be moved relative to end surface 2 of plenum 1 to adjust or close off low velocity jet 9.

Figure 2:
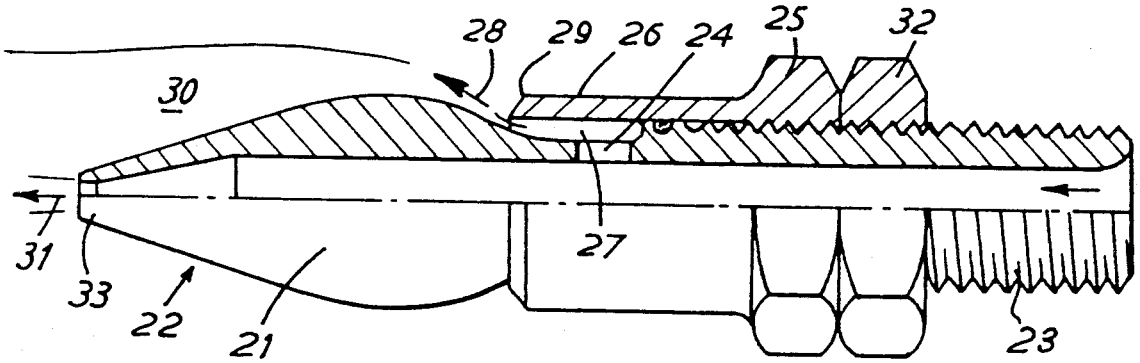

Referring to FIG. 2 there is shown a first plenum 21 with a fluidic surface 22, which is somewhat more elongate than the surface of the nozzle shown in FIG. 1. An inlet 23 for passage of fluid into plenum 21 has a number of apertures 24 in its side wall. The inlet 23 is screw threaded along a part of its length and carries a nut 25 with an axially extending collar 26 which extends over the apertures 24 in the direction of the plenum 22 to define a second plenum 27. An adjustable outlet 28 is formed between the end 29 of the collar 26 and the fluidic surface 22. Fluid can flow through the outlet 28 and is constrained to flow in contact with fluidic surface 22 to form a low velocity jet 30 surrounding high pressure jet 31. Adjustment of the nut 25 can close outlet 28 to shut off the outer jet or to open the outlet 28 to adjust the flow of the outer jet. A lock nut 32 holds the nut 25 in a desired position.

Both forms of nozzles described are small, inexpensive and reliable compared with other compound nozzles known in the art and distinct from such nozzles by conveniently deriving the fluid for their secondary jet from the same source as the main jet.

Figure 3:
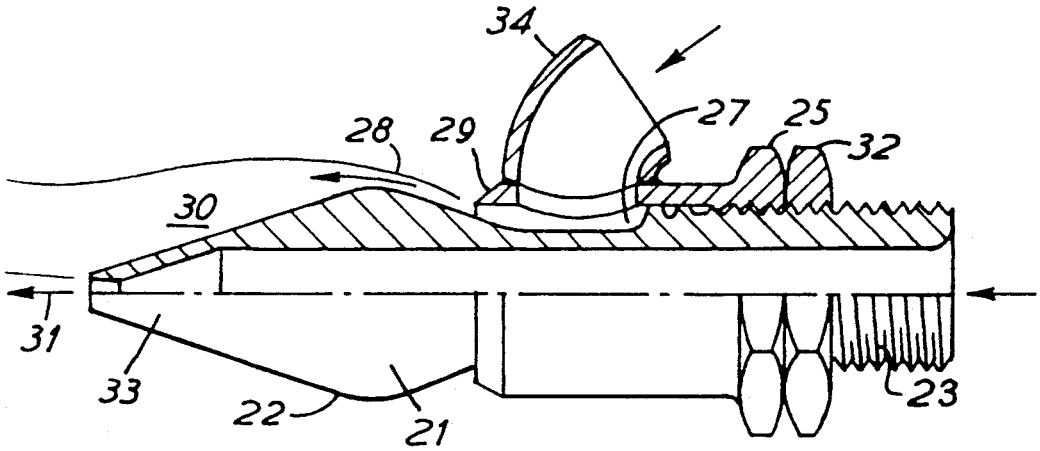

Modifications to the jetting nozzles described allow flexibility of the use of the nozzles to allow either jet to be used alone or the jet to be formed of different fluids. Thus, as described, providing a shutdown valve on the nozzle exit 3 or 33 allows the high velocity jet to be shut off. Any such valve or its method of mounting should, of course be such that the flow pattern of neither jet is substantially undisturbed. The low velocity jet can be shut off by the means described. With the nozzle of FIG. 2 means can be provided for closing apertures 24 and for introducing an independent fluid supply to plenum 27. Alternatively, as shown in FIG. 3, the nozzle can be formed without apertures 24 and side tube 34 can feed an independent fluid supply to plenum 27.

Figure 4:
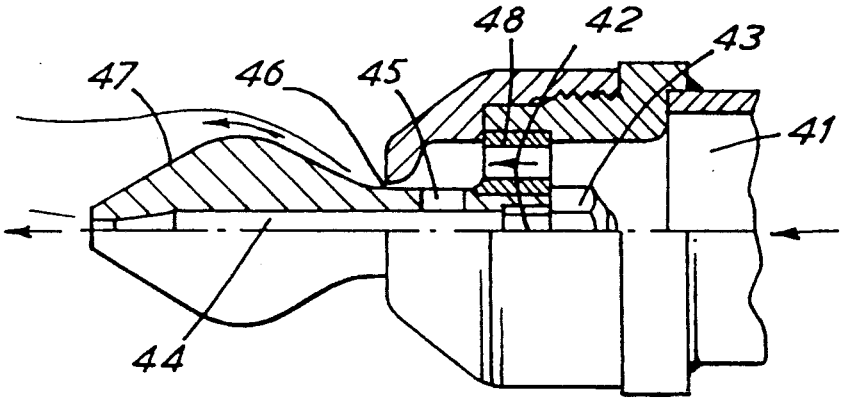

FIG. 4 shows a further embodiment according to the first aspect of the invention in which the high pressure fluid from pipe 41 flows around a spear member 42 which is closed at its upstream end 43 and at its downstream end carries first plenum chamber 44, such that the main jet of fluid enters plenum chamber 44 through apertures 45. The secondary jet of fluid by-passes apertures 45 and exits through the annular passage 46 to impinge on fluid surface 47 of the fluid plenum chamber 44. Spear member 42 is mounted on a spider 48 or similar device allowing passage of fluid.

Figure 5:
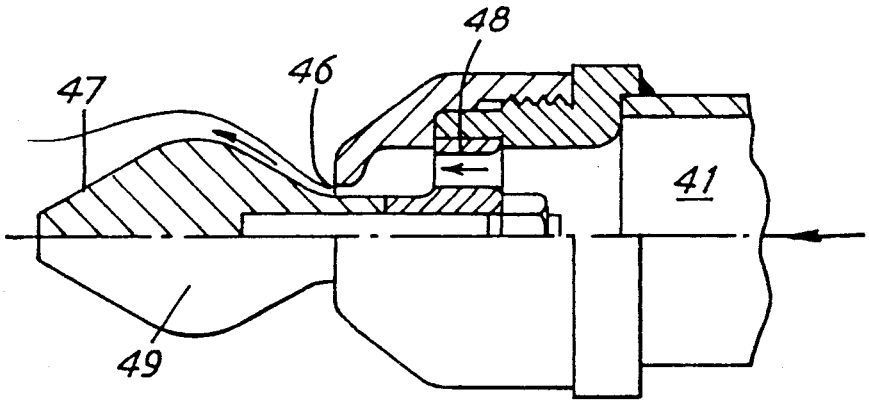
FIGS. 5 and 6 are schematic representations of two embodiments of the second aspect of the invention.

FIG. 5 shows a similar arrangement to that shown in FIG. 4 but according to the second aspect of the invention. In this case the fluidic surface 47 is the surface of a solid body 49 which simply acts as a converter device to reduce the velocity and increase the area of the annular jet issuing from passage 46.

Figure 6:
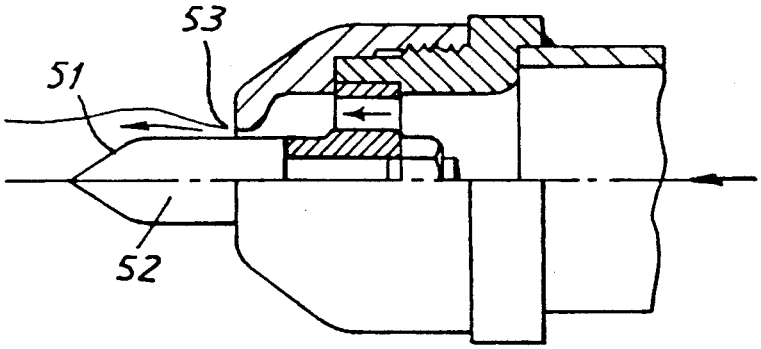

FIG. 6 shows an embodiment of the second aspect of the invention in which fluid is fed axially onto the fluidic surface 51 of a converter device 52 which is cylindrical at the point where fluid issues from annular passage 53. Converter device 52 is carried as a spider 54 or similar device.

The arangement of FIG. 6 could, of course, be modified to provide a jetting nozzle according to the first aspect of the invention by forming converter device 52 as a hollow body with a plenum chamber and means for introduction and exit of fluid, as described in connection with FIGS. 1 to 4.

Applications of the jetting nozzle of the invention include:

1. Sea-bed cutting by remotely operated vehicle in connection with cablelaying and maintenance. (Inner and outer jets of water.)

The inner jet cuts by virtue of its high specific kinetic energy, whilst the outer jet disperses by virtue of its high volume and stream function.

2. Water-jet cutting of steel, concrete etc, in air and water. (Inner jet of water, outer jet of air or water.)

In air, an air shroud can completely eliminate shear stress between the cutting jet and the surrounding fluid, thus preventing degradation. Under water, a water shroud will reduce degradation.

3. Simultaneous sweeping and cooling of mine stopes. (Inner jet of water, outer jet of air.)

The air shroud prevents degradation of the jet, extending its effective range in air. The water is cooler when it reaches the impact zone since the air shroud is cold by virtue of its expansion in the annular nozzle, and the water surface is much less for having preserved its integrity.

4. Mine ventilation. (Outer jet only, of air. I.e., same device may be used for both purposes c and d.)

A low-volume air supply, conveniently piped, may be used to generate a high-volume secondary airflow, typically of the order of forty times as great. This high flow would otherwise require a bulky, inconvenient, heavy and costly installation to generate it.

5. Airmoving. (Outer jet only, of air.)

In a conventional fluidic venturi-pattern airmover the motive air leaves the annular nozzle in a radially inward direction. This means that unless a costly machining operation is undertaken the nozzle area contracts towards the exit. At a motive pressure above that which provides sonic velocity at the exit energy is lost across a shock wave just outside the nozzle exit. An expansion is necessary to recover this energy but the cost of machining the necessary profile is such that this operation is not normally carried out and the resulting reduction in efficiency, greater at higher pressures but typically of the order of one-quarter to one-third, is accepted. In the present device the discharge is radially outward and the desirable radial expansion is readily obtained by a parallel orifice at no additional cost. These units are used for ventilation of a workspace, for example removal of welding or paint fumes, and for clearing swarf.

6. Pipe cleaning. (Outer jet only, of air.)

After descaling or grit-blasting the inside of a pipe, the spent abrasive, rust, old paint and scale may be removed from the pipe by plugging a unit into one end and using a modest quantity of compressed air delivered through a small and manageable hose to generate a high volume flow.

7. Anchorage. (Outer jet only, of water, or inner and outer jets, both of water.)

A straight metal tube having a unit on the lower end and connected at the upper end will dig itself into an underwater deposit. This will be more rapid if the deposit is permeable, non-cohesive and does not contain stones. Having been lowered to the required depth, perhaps several metres, the water supply may be disconnected. By virtue of a combination of the weight and passive pressure of overlying material the enlargement at the bottom, represented by the unit, prevents withdrawal. On reconnection of the supply, the material lying against the fluidic surface prevents reestablishment of the original flow pattern and the jet emerges radially, creating a cavity around and above the device, facilitating withdrawal. This has extensive application subsea.

8. Propulsion. (Outer jet only, of water.)

Two examples suffice to demonstrate the advantages. In a jet pump dredger it is convenient to effect self-propulsion by means of water jets driven by the jet pump motive supply. These jets have a high velocity and can cause damage to adjacent vessels, river bank etc. The device reduces the velocity without materially affecting the static thrust or the thrust at the low velocities at which a dredge maneuvers. A remotely-operated submersible vehicle is driven by ducted propellers. These require that a clear column of water should be able to pass through the volume of space enclosing the vehicle, and thus cannot be made steerable. Therefore several propulsors are necessary and the volume available for the vehicle is largely occupied by water columns. The present device requires no inlet water column and therefore occupies only of the order of 10% of the vehicle volume. And the device can be steerable, reducing not only the number but also the weight so that more payload can be carried.

9. Retro-jets. (Outer jet only, of water.)

Water jets are used by divers and remotely-operated submersible vehicles for dispersion of sediment. To eliminate recoil, an equal and opposite jet is arranged. This jet has a velocity equal to that of the principal jet and is thus potentially dangerous to diver and vehicle alike. The velocity of the balancing jet can be reduced without affecting its effectiveness by fitting the device.

10. Burners. (Outer jet only, of fuel gas or vapour.)

The developing jet is extremely turbulent and the motive fluid (fuel) is quickly mixed intimately with the ambient fluid (air) to form an efficient mixture for combustion. An application exists in all gas and light oil boilers and space heaters.

11. Pressure converter. (Outer jet only.)

In a jet pump dredge the jet pump requires water of a given pressure which is likely to be higher than that required for disintegration of the deposit by water jets. Therefore it is normal to fit two motive pumpsets. The device can be used to produce a jet of lower velocity but higher volume from a low volume jet of high velocity. Thereby the disintegration pumpset may be eliminated. Through the use of a single pumpset the further facility is afforded of controlling the apportionment of energy between jet pump and disintegration jets, thus allowing the performance of the machine to be optimized as the deposit varies. Also, if a water jet excavation device has to deal with a range of deposit characteristics it is normal to have to fit more than one pumpset so that the pressure appropriate to the deposit can be generated. If jets based on the present device are installed, only one pumpset need be fitted, having a delivered pressure equal to the highest required. A velocity equivalent to any lower pressure can then be generated by suitable specification of a simple screw-in or snap-in device.

12. Mixing. (Outer and inner jets of the same or different fluids.)

Owing to the high turbulence in the mixing zone, the device may be used as a two-or three-component mixer. The three components would be inner jet, outer jet and ambient fluid. Two components would be outer jet and ambient fluid.

13. Tank ventilation. (Outer jet only, of gas.)

The unit is conveniently fitted into a flange for panel mounting for the ventilation of tanker holds, chemical tanks, sewage digesters, food processing tanks and vats etc. It may be driven from a small compressed air line. An advantage of the device is that the motive pressure required does not have to be high. Thus it may be driven by the exhaust of a diesel engine without imposing an unacceptable back pressure, no compressor then being needed. An added advantage in this application may be the reduction in the level of exhaust noise of the engine.

14. Cooling and air conditioning. (Outer jet air, optional surface water.)

A working atmosphere may be cooled by expansion of compressed ventilation air through a nozzle. However, the resulting jet is very fast and potentially dangerous either directly or indirectly as it picks up foreign matter. Also, mixing of the cooling air with the ambient air follows an inconvenient long, narrow jet pattern. The fluidic nozzle does not interfere in any way with the cooling action but is able to produce a congenial, relatively diffused and completely safe cooling breeze. In a development of the device, water may be introduced at small holes in the fluidic surface. This is assisted by the reduced pressure where the surface is concave and velocity high, so that the water need not be supplied under pressure. This water rapidly becomes absorbed to form a humidified airstream or, by an excess of water, a cool mist.

I claim:

1. An apparatus for producing a high volume, low velocity jet from a low volume high velocity supply, comprising: means for supplying fluid at low volume and high pressure and, within or adjacent the outlet of said means for supplying, a converter device arranged axially of the direction of flow of said fluid and comprising a body having a fluidic surface, whereby fluid issues from the outlet as an annular jet at low volume and high pressure and is constrained by the contours of the surface of the converter device to flow in contact with the surface so that the jet area is increased thereby increasing the flow and reducing the velocity of the jet.

2. A jetting nozzle comprising:

means for producing a high velocity fluid jet, said means for producing including a fluidic surface, an inlet opening and an outlet opening downstream of the inlet opening;

means for producing relatively lower velocity fluid jet with respect to and surrounding the high velocity fluid jet, said means for producing including at least one inlet opening and at least one outlet opening downstream of the at least one inlet opening;

means for selectively shutting down said high and low velocity fluid jets either simultaneously or independently;

means for introducing plural fluids into said jetting nozzle for supplying the high and low velocity fluid jets; and means for selectively controlling relative fluid velocity of both said high and low velocity fluid jets;

whereby a rate of divergence of the high velocity fluid jet exiting from said means for producing a high velocity fluid jet is selectively controlled by the low velocity fluid jet thereby increasing an effective range of the high velocity fluid and preserving fluidic energy of said jetting nozzle.

3. A jetting nozzle according to claim 2, wherein the lower velocity fluid jet is derived from the high velocity fluid jet.

4. A jetting nozzle according to claim 3, wherein the lower velocity fluid jet is derived by bleeding off a side stream of fluid from the high velocity fluid jet.

5. A jet nozzle according to claim 2, wherein the lower velocity fluid jet is fed onto the fluidic surface with a radial component.

6. The jetting nozzle according to claim 2, wherein said means for producing a high velocity fluid jet is a first plenum chamber through which a primary stream of fluid is introduced, wherein the outlet opening is reduced with respect to a diameter of said first plenum.

7. The jetting nozzle according to claim 2, wherein said means for producing a relatively lower velocity fluid jet includes a second plenum having a plurality of apertures formed therein for diverting a portion of a primary stream of fluid to an exterior circumferential surface of said means for producing a high velocity fluid jet, thereby controlling a rate of divergence of the high velocity fluid jet within the relatively lower velocity fluid jet.

8. The jetting nozzle according to claim 2, wherein said means for selectively shutting down said high velocity fluid jet includes a shut-down valve positioned at the outlet opening of said mean for producing a high velocity fluid jet.

9. The jetting nozzle according to claim 2, wherein said means for selectively shutting down said relatively low velocity fluid jet includes a shut-down valve positioned at said at least one outlet opening.

10. The jetting nozzle according to claim 2, wherein said means for introducing at least one fluid into said jetting nozzle includes a nozzle inlet for receiving a single fluid source distributable to both said means for producing high and relatively low velocity fluid jets.

11. The jetting nozzle according to claim 2, wherein said means for introducing at least one fluid into said jetting nozzle includes a first nozzle inlet for receiving a primary fluid source distributed as said high velocity fluid jet and a second nozzle inlet for receiving a secondary fluid source distributed as said relatively low velocity fluid jet.

12. The jetting nozzle according to claim 2, wherein said means for selectively controlling relative fluid velocity includes manipulation of shapes of said first and second plenums.

13. The jetting nozzle according to claim 2, wherein said fluidic surface is a substantially heart-shaped plenum.

* * * * *